US005196066A

United States Patent [19]

Kusuda et al.

[11] Patent Number: 5,196,066

[45] Date of Patent: Mar. 23, 1993

[54] FACING MATERIAL SPRAY APPARATUS

[75] Inventors: Motoo Kusuda; Hirokazu Ueda, both of Nara; Hitoshi Masuda, Yamatotakada, all of Japan

[73] Assignee: Kusuda Company Limited, Nara, Japan

[21] Appl. No.: 783,416

[22] Filed: Oct. 28, 1991

[51] Int. Cl.[5] ..... B05C 5/00

[52] U.S. Cl. ..... 118/612; 118/312; 118/300

[58] Field of Search ..... 118/300, 312, 326, 612, 118/689

[56] References Cited

U.S. PATENT DOCUMENTS 4,527,510 7/1985 Arndt ..... 118/324

5,063,874 11/1991 Podds et al. ..... 118/602

*Primary Examiner*—W. Gary Jones

*Assistant Examiner*—Charles K. Friedman

*Attorney, Agent, or Firm*—Cohen, Pontani, Lieberman, Pavane

[57] ABSTRACT

A facing material spray apparatus including a first tank for housing a facing material and regulating its concentration, first agitating means for agitating the facing material in the first tank, a second tank, for receiving the facing material from the first tank, provided in the vicinity of the first tank with its bottom positioned below the bottom of the first tank, second agitating means for agitating the facing material in the second tank, a connecting pipe for connecting the first and second tanks to each other and causing the facing material in the first tank to naturally flow into the second tank, a valve attached to the connecting pipe for opening and closing a facing material supply passage, a facing pump removably attached to the second tank for sucking the facing material in the second tank, a nozzle attached to the facing pump through a hose for spraying the sucked facing material on a mold, and a facing material receiving base provided in the vicinity of the second tank for receiving the facing material sprayed on the mold and recovering the received facing material to the second tank by virtue of its natural flow.

3 Claims, 6 Drawing Sheets

FACING MATERIAL SPRAY APPARATUS

BACKGROUND OF THE INVENTION (i) Field of the Invention

The present invention relates to a facing material spray apparatus, and more particularly to a facing material spray apparatus for spraying a facing material on a mold surface which is to be used in carrying out facing as one of molding steps in sand mold casting.

(ii) Description of the Prior Art

Conventionally, there has widely been used a method for facing a mold surface with a substance (facing material) such as graphite, magnesia or zirconium before mold covering in order to perform sand-falling well and to make a casting surface smooth when carrying out molding in sand mold casting. More specifically, there is added to the facing material an iron oxide material or then like as and additive in an amount of about 10% by weight. Then, they are kneaded well and are coated on the mold surface by a brush or spray.

When using the brush or spray, however, a lot of time is required for coating so that it is hard to attain mass production. In addition, human labor is too great. Consequently, there has been used a facing material spray apparatus in carrying out facing.

The facing material spray apparatus mainly comprises a tank for housing a facing material, a facing pump attached to the tank for sucking the facing material in the tank, a nozzle attached to the pump for spraying the sucked facing material on a mold, a facing material receiver for receiving the facing material which is sprayed on the mold through the nozzle, and a recovery pump for recovering to the tank the facing material received by the facing material receiver.

According to the facing material spray apparatus of this type, the time for facing can greatly be shortened. In addition, the human labor can be reduced.

However, there are caused the following problems: (1) it is hard to regulate the concentration of the facing material and a lot of time is required to regulate the concentration, (2) piping portions are clogged with the facing material or molding sand, (3) it is difficult to completely carry out kneading so that the nonuniformity of facing can easily be caused. (4) the facing pump and recovery pump can easily break down, and (5) a lot of time is required to clean the tank, the pump and the like.

It is an object of the present invention to provide a facing material spray apparatus in which the above-mentioned drawbacks are eliminated.

SUMMARY OF THE INVENTION

The present invention provides a facing material spray apparatus comprising a first tank for housing a facing material and regulating its concentration, first agitating means for agitating the facing material in the first tank, a second tank, for receiving the facing material from the first tank, provided in the vicinity of the first tank with its bottom positioned below the bottom of the first tank, second agitating means for agitating the facing material in the second tank, a connecting pipe for connecting the first and second tanks to each other and causing the facing material in the first tank to naturally flow into the second tank, a valve attached to the connecting pipe for opening and closing a facing material supply passage, a facing pump removably attached to the second tank for sucking the facing material in the second tank, a nozzle attached to the facing pump through a hose for spraying the sucked facing material on a mold, and a facing material receiving base provided in the vicinity of the second tank for receiving the facing material sprayed on the mold and recovering the received facing material to the second tank by virtue of its natural flow.

According to the present invention, the facing material spray apparatus is characterized by the first tank for housing the facing material and regulating its concentration and the second tank for receiving the facing material from the first tank. The second tank is provided with its bottom positioned below the bottom of the first tank.

The first and second tanks are connected to each other by means of a valved connecting pipe. Consequently, the facing material in the first tank can naturally flow into the second tank. It is preferred that the connecting pipe is as short as possible and has few horizontal portions.

The first and second tanks have agitating means for agitating the facing material therein, respectively. In general, the agitating means is a vaned agitator which is removably attached to the tank.

The facing material spray apparatus of the present invention is also characterized by the facing material recovery means in place of the recovery pump which has conventionally been needed. More specifically, there is provided in the vicinity of the second tank the facing material receiving base for receiving the facing material sprayed on the mold and recovering the received facing material to the second tank by virtue of its natural flow. In order to recover the received facing material to the second tank by virtue of its natural flow, there is used, for example, an inclined recovery conduit provided below a facing material receiving base body and having a downstream end which reaches the top of the second tank.

According to the facing material spray apparatus of the present invention, furthermore, it is preferred that the connecting pipe includes an opening provided on the downstream side of a valve for feeding air from the outside to the facing material supply passage of the connecting pipe. The opening is generally provided upward. When the connecting pipe is clogged with the facing material, molding sand or the like, the opening is used for feeding compressed air so as to cause the sand or the like to blow off into the first or second tank.

Since the facing material spray apparatus of the present invention has the above-mentioned structure, the following effects can be obtained: (1) it is easy to regulate the concentration of the facing material and the time for regulation can be shortened, (2) piping portions are seldom clogged with the molding sand or facing material, (3) kneading can completely be carried out so that the nonuniformity of facing is seldom caused, (4) the facing pump rarely breaks down, and (5) a lot of time is not required to clean the tank, the pump and the like.

BRIEF DESCRIPTION OF THE DRAWINGS

FIGS. 1 to 4 show a first embodiment of the present invention, in which:

FIG. 1 is a front view;

FIG. 2 is a plan view;

FIG. 3 is a right side view;

FIG. 4 is section view, partially taken along the line IV—IV in FIG. 2;

FIGS. 5 and 6 show a second embodiment of the present invention, in which:

FIG. 5 is a front view; and

FIG. 6 is a plan view.

DETAILED DESCRIPTION OF THE PREFERRED EMBODIMENTS

Figure 1:
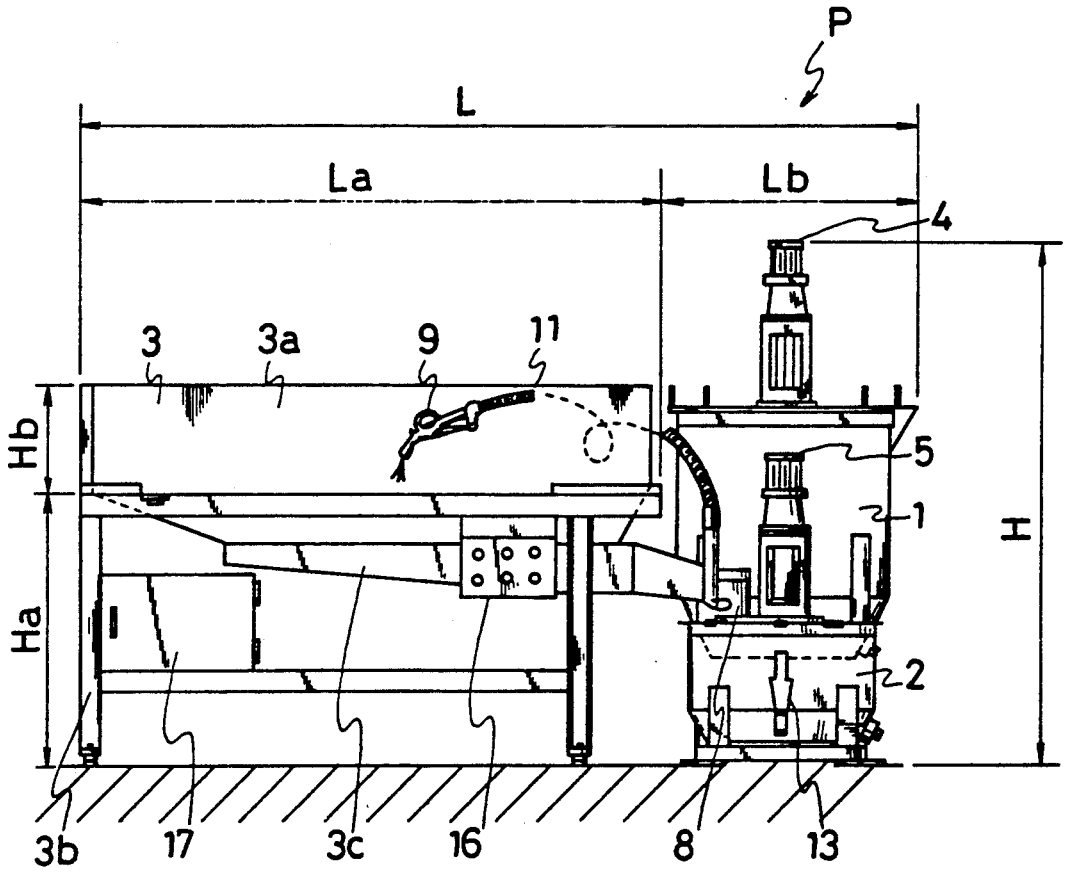

Two preferred embodiments of the present invention will be described in detail with reference to the drawings. The present invention is not limited to the following embodiments.

First Embodiment

As shown in FIGS. 1 to 4, a facing material spray apparatus P mainly comprises a first tank, 1, a second tank 2, a facing material receiving base 3, a first agitator 4 as first agitating means, a second agitator 5 as second agitating means, a connecting pipe 6, a valve 7, a facing pump 8, and nozzle 9.

The first tank 1 serves to house a facing material 10 therein and regulate its concentration. The facing material 10 is obtained by mixing water as a solvent and graphite as a bony material at a weight ratio of 3:1 and then adding thereto an iron oxide material in an amount of 10% by weight. A specific gravity is regulated to 15° Bé (Baumé) (by means of a statutory Baumé's hydrometer).

The second tank 2 serves to receive the facing material 10 from the first tank 1, and is provided beside the first tank 1 with its bottom positioned below the bottom of the first tank 1. The first and second tanks 1 and 2 are made of stainless steel and cylinder-shaped.

The facing material receiving base 3 is provided beside the first and second tanks 1 and 2, and includes a receiving base body 3*a*, a leg 3*b* and inclined recovery conduit 3*c*. The receiving base body 3*a* has a rectangular frame and four inclined walls provided in the frame. The leg 3*b* serves to support the receiving base body 3*a* at a predetermined height. The inclined recovery conduit 3*c* is provided below the receiving base body 3*a* and has a downstream end which reaches the top of the second tank 2.

The first agitator 4 has a two-stage agitating vane and is attached to the first tank 1 vertically. The second agitator 5 has a one-stage agitating vane and is attached to the second tank 2 vertically.

The connecting pipe 6 is an L-shaped pipe having horizontal and vertical portions, and connects the lower portion of the side wall of the first tank 1 to the lid portion of the second tank 2. The inside of the connecting pipe 6 is a facing material supply passage. The facing material 10 in the first tank 1 is caused to naturally flow into the second tank 2 through the facing material supply passage. The valve 7 serves to open and close the facing material supply passage of the connecting pipe 6, and is provided in the middle of the horizontal portion of the connecting pipe 6.

In the curved portion of the connecting pipe 6 is provided an L-shaped opening 6*a* which communicates with the facing material supply passage. The opening 6*a* is opened vertically and upward, and can feed air from the outside to the facing material supply passage. The connecting pipe 6 has a peep hole 6*b* between the valve 7 and the opening 6*a*.

The facing pump 8 is in the form of a coolant, and serves to suck the facing material 10 in the second tank 2. The nozzle 9 is attached to the pump 8 through a hose 11, and serves to spray on a mold (not shown) the facing material 10 sucked by the pump 8.

Figure 2:
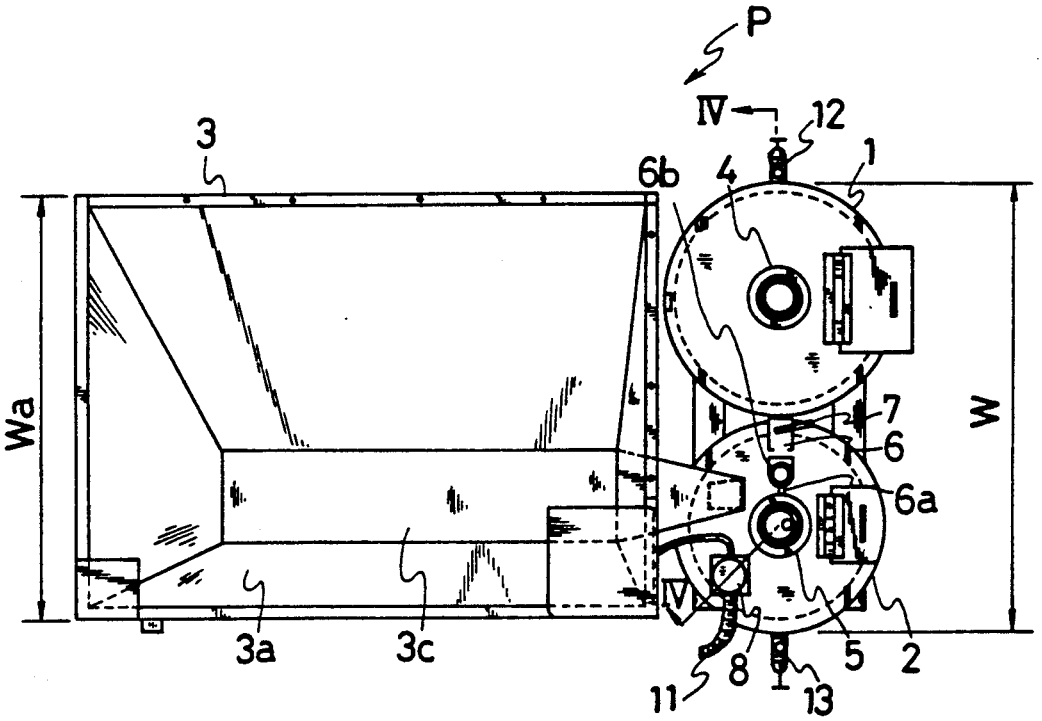
Figure 3:
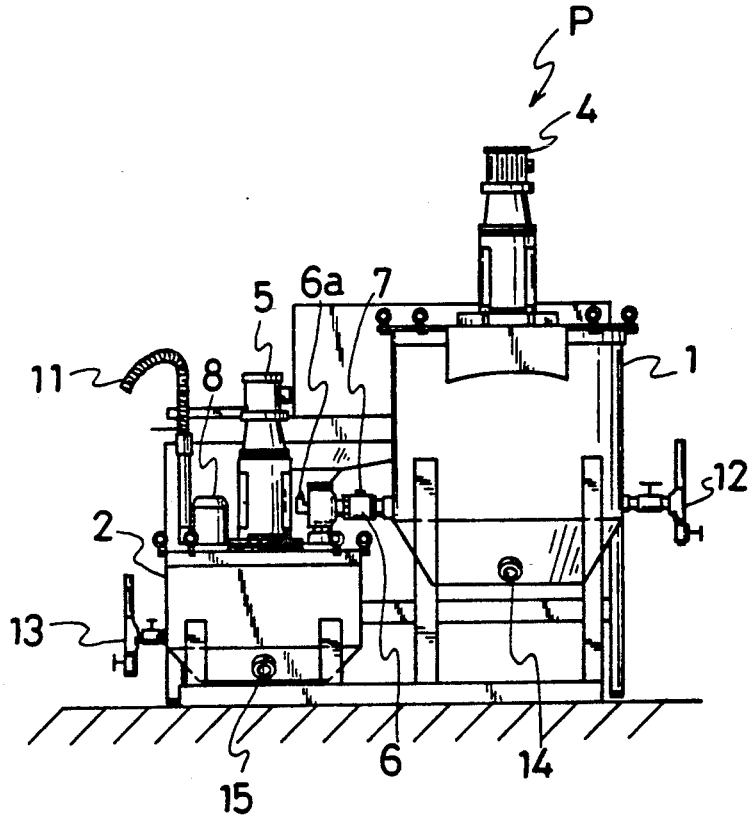
Figure 4:
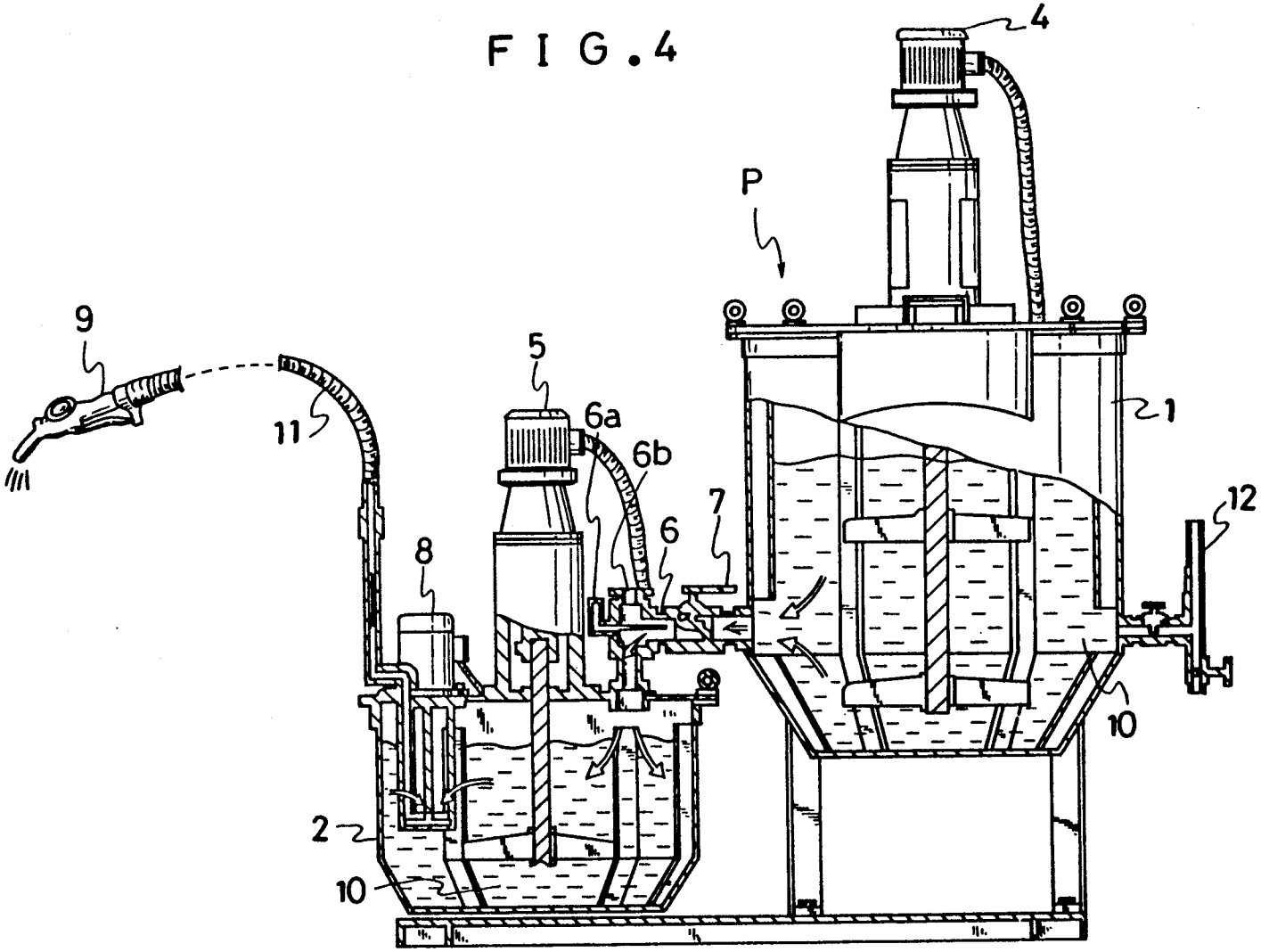

The reference numeral 12 denotes a first L-shaped pipe provided on the first tank 1 for measuring a specific gravity. The reference numeral 13 denotes a second L-shaped pipe provided on the second tank 2 for measuring a specific gravity. The reference numerals 14 and 15 denote facing material exhaust ports. The reference numeral 16 denotes an operation panel. The reference numeral 17 denotes a control panel. In FIGS. 1 and 2, dimensions are as follows: L=275 cm, La=190 cm, Lb=85 cm, H=175 cm, Ha=90 cm, Hb=35 cm, W=150 cm, and Wa=140 cm.

There will be described a method for operating the facing material spray apparatus P. At first, the switch of the control panel 17 is turned ON. It is confirmed whether the valve 7 is closed. Then, the prepared facing material 10 is housed in the first tank 1. Thereafter, the first agitator switch of the operation panel 16 is turned ON to rotate the first agitator 4 and fully agitate the facing material 10 in the first tank 1. The Baumé's hydrometer is set on the first L-shaped pipe 12 so as to measure the concentration of the facing material 10 in the first tank 1. If the concentration is proper, the valve 7 is opened to feed the facing material 10 into the second tank 2. When a proper amount of the facing material 10 is fed into the second tank 2, the valve 7 is closed.

When the facing material 10 is not smoothly fed from the first tank 1 to the second tank 2, the valve 7 is kept open so as to supply compressed air through the opening 6*a* of the connecting pipe 6.

Then, the second agitator switch of the operation panel 16 is turned ON to rotate the second agitator 5 and fully agitate the facing material 10 in the second tank 2. Thereafter, the pump switch of the operation panel 16 is turned ON to operate the pump 8, so that the facing material 10 is sucked from the second tank 2 and is sprayed on the mold through the nozzle 9. At any time, the concentration of the facing material 10 in the second tank 2 is measured by means of the Baumé's hydrometer set on the second L-shaped pipe 13. If the concentration is not proper, the water or bony material is put in the second tank 2 so as to regulate the concentration properly.

When facing is terminated, the pump switch is turned OFF. After facing, the facing material 10 naturally flows through the recovery conduit 3*c* of the facing material receiving base 3 and is then recovered by the second tank 2. When the facing material 10 in the second tank 2 gets low and is not fed through the nozzle 9, the facing material 10 in the first tank 1 is supplied to the second tank 2.

When facing is completed, all the switches of the operation panel 16 are turned OFF and the switch of the control panel 17 is turned OFF.

According to the facing material spray apparatus P, (1) two tanks 1 and 2 are provided so that it is easy to regulate the concentration of the facing material 10 and the time for regulation can be shortened, and (2) the facing material 10 in the first tank 1 naturally flows into the second tank 2 through the connecting pipe 6 and the facing material 10 received by the receiving base body 3*a* of the facing material receiving base 3 naturally flows through the recovery conduit 3*c*, so that piping portions are seldom clogged with molding sand or the facing material 10. If the piping portions are clogged with the molding sand or facing material 10, the compressed air is supplied through the opening 6a of the connecting pipe 6 so that the sand or the like can blow off into the first tank 1 or second tank 2.

Furthermore, (3) since there are provided the two tanks 1 and 2 having the agitators 5 and 6, kneading can completely be carried out so that the nonuniformity of facing is rarely caused, (4) since the piping portions are seldom clogged with the molding sand or facing material 10, the facing pump 8 rarely breaks down, and (5) since the two tanks 1 and 2 are provided and the piping portions are seldom clogged with the molding sand or facing material 10, a lot of time is not required to clean the tanks 1 and 2, the pump 8 and the like.

Second Embodiment

Figure 5:
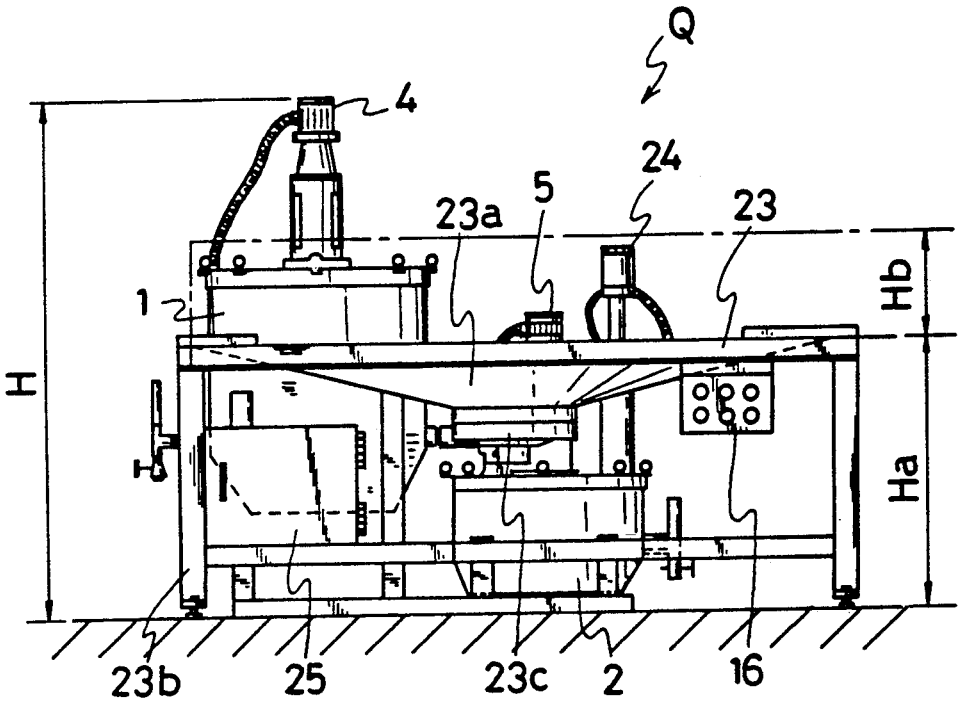
Figure 6:
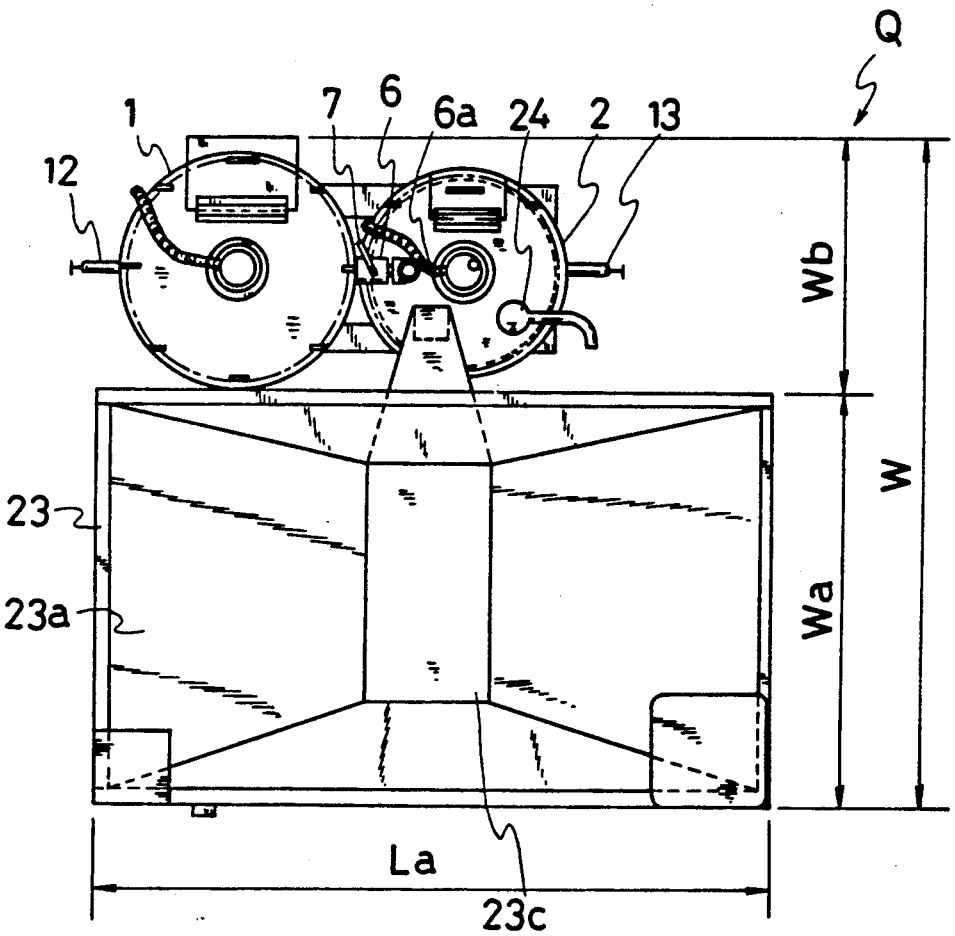

As shown in FIGS. 5 and 6, a facing material spray apparatus Q mainly comprises a first tank 1, a second tank 2, a facing material receiving base 23, a first agitator 4 as first agitating means, a second agitator 5 as second agitating means, a connecting pipe 6, a valve 7, a facing pump 24, and a nozzle (not shown).

The facing material receiving base 23 is provided beside the first and second tanks 1 and 2, and includes a receiving base body 23a, a leg 23b and an inclined recovery conduit 23c. The receiving base body 23a has a rectangular frame and four inclined walls provided in the frame. The leg 23b serves to support the receiving base body 23a at a predetermined height. The inclined recovery conduit 23c is provided below the receiving base body 23a and has a downstream end which reaches the top of the second tank 2. In addition, the inclined recovery conduit 23c is provided perpendicularly to the longitudinal direction of the receiving base body 23a, differently from a first embodiment.

The facing pump 24 is rod-shaped and serves to suck the facing material in the second tank 2. The reference numeral 25 denotes a control panel. In FIGS. 5 and 6, dimensions are as follows: La=300 cm, H=175 cm, Ha=90 cm, Hb=35 cm, W=225 cm, Wa=140 cm, and Wb=85 cm.

Since other structures and the operating method of the facing material spray apparatus Q are almost the same as in the first embodiment, their detailed description will be omitted. In the case where the facing material spray apparatus Q is used, there can be obtained the same effects as in the first embodiment.

What is claimed is:

1. A facing material spray apparatus comprising:

a first tank for housing a facing material and regulating its concentration:

first agitating means for agitating the facing material in the first tank:

a second tank, for receiving the facing material from the first tank, provided adjacent to and below the bottom of the first tank:

second agitating means for agitating the facing material in the second tank:

a connecting pipe for connecting the first and second tanks to each other and causing the facing material in the first tank to gravity flow into the second tank:

a valve attached to the connecting pipe for opening and closing a facing material supply passage;

a facing pump removably attached to the second tank for sucking the facing material in the second tank;

a nozzle attached to the facing pump through a hose for spraying the sucked facing material on a mold; and a facing material receiving base provided adjacent to the second tank for receiving the facing material sprayed on the mold and recovering the received facing material not remaining on the mold to the second tank by virtue of its gravity flow.

2. A facing material spray apparatus according to claim 1, wherein the connecting pipe includes an opening disposed downstream the valve for feeding air from outside into the pipe interior to blow away any plugging caused by at least one of the mold sand the facing material back to the first or second tank.

3. A facing material spray apparatus according to claim 2, wherein the facing material receiving base includes a receiving base body having a rectangular frame and four inclined walls provided in the frame, a leg for supporting the receiving base body at a predetermined height, and an inclined recovery conduit provided below the receiving base body and having a downstream end which reaches the top of the second tank.

* * * * *